US006845887B1

(12) United States Patent
Granger et al.

(10) Patent No.: US 6,845,887 B1
(45) Date of Patent: Jan. 25, 2005

(54) POURER AND INCORPORATED POURER CAP

(75) Inventors: Jacques Granger, Libourne (FR); Jean-Marie Bourreau, Ouroux-sur-Saone (FR)

(73) Assignee: Pechiney Emballage Alimentaire, Clichy (FR)

( * ) Notice: Subject to any disclaimer, the term of this patent is extended or adjusted under 35 U.S.C. 154(b) by 244 days.

(21) Appl. No.: 10/110,767

(22) PCT Filed: Nov. 2, 2000

(86) PCT No.: PCT/FR00/03045

§ 371 (c)(1),
(2), (4) Date: Jun. 13, 2002

(87) PCT Pub. No.: WO01/32523

PCT Pub. Date: May 10, 2001

(30) Foreign Application Priority Data

Nov. 3, 1999 (FR) ..... 99 14016

(51) Int. Cl.[7] ..... B65D 47/10

(52) U.S. Cl. ..... 222/153.06; 222/541.6; 222/542; 222/564; 222/569; 222/571

(58) Field of Search ..... 222/153.06, 153.14, 222/541.6, 542, 564, 566, 567, 569, 571

(56) References Cited

U.S. PATENT DOCUMENTS

| | | | | | |
|---|---|---|---|---|---|
| 2,834,497 | A | * | 5/1958 | Wolf | 222/571 |
| 2,848,145 | A | | 8/1958 | Livingstone | 222/542 |
| 3,143,257 | A | * | 8/1964 | Victor | 222/547 |
| 3,311,275 | A | * | 3/1967 | Gibson | 222/567 |
| 3,630,419 | A | * | 12/1971 | Pierce | 222/478 |
| 3,926,348 | A | | 12/1975 | Lutzker | 222/189 |
| 5,397,027 | A | * | 3/1995 | Koch et al. | 222/1 |
| 5,799,836 | A | * | 9/1998 | Lee | 222/189.07 |
| 5,950,876 | A | * | 9/1999 | McLelland et al. | 222/153.06 |
| 6,026,994 | A | * | 2/2000 | Rigel | 222/538 |
| 6,230,944 | B1 | * | 5/2001 | Castellano et al. | 222/481.5 |

FOREIGN PATENT DOCUMENTS

| | | |
|---|---|---|
| FR | 1156919 | 5/1958 |
| NL | 7703829 | 10/1978 |
| WO | 98/52838 | 11/1998 |

* cited by examiner

*Primary Examiner*—Joseph A. Kaufman
(74) *Attorney, Agent, or Firm*—Dennison, Schultz, Dougherty & MacDonald

(57) ABSTRACT

A spill-proof pouring device for fixing inside the neck of a bottle includes a skirt sealing to the inside of the neck on its outer surface and having an internal channel. An upper flared portion of the skirt protrudes beyond the lip of the neck, and is formed of a flexible material. The flared portion joins the skirt at a point of union of reduced thickness to permit flexing action by the protruding portion.

20 Claims, 6 Drawing Sheets

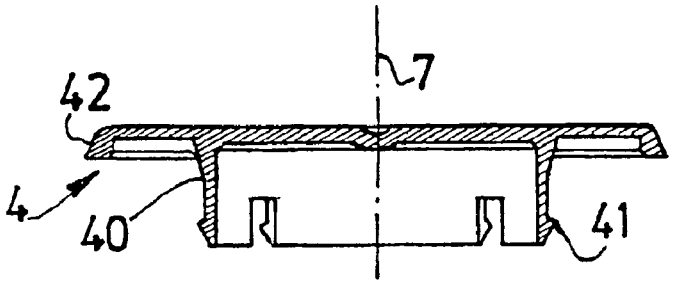
FIG. 3a
FIG. 3b
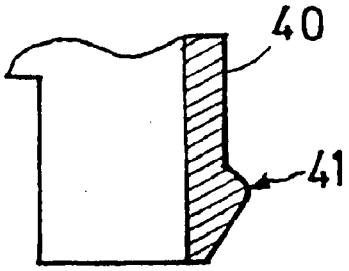
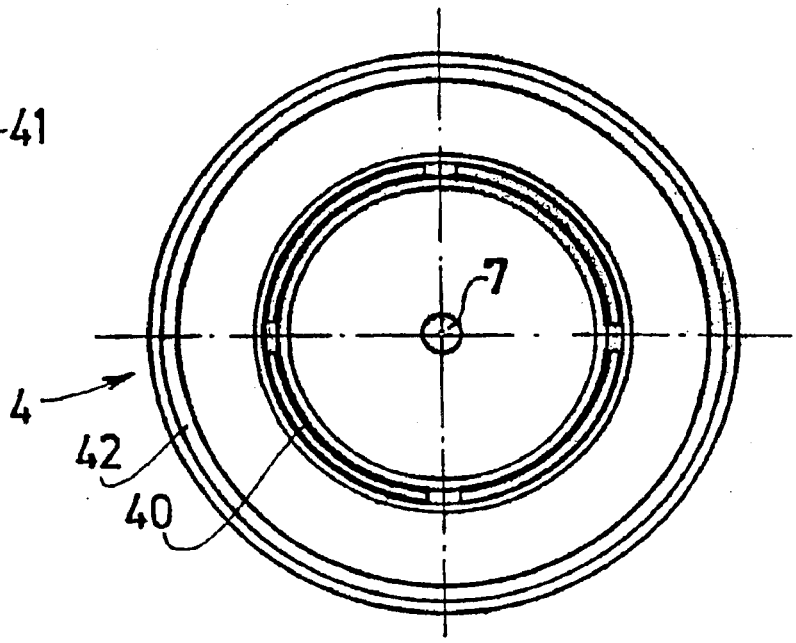
FIG. 3c
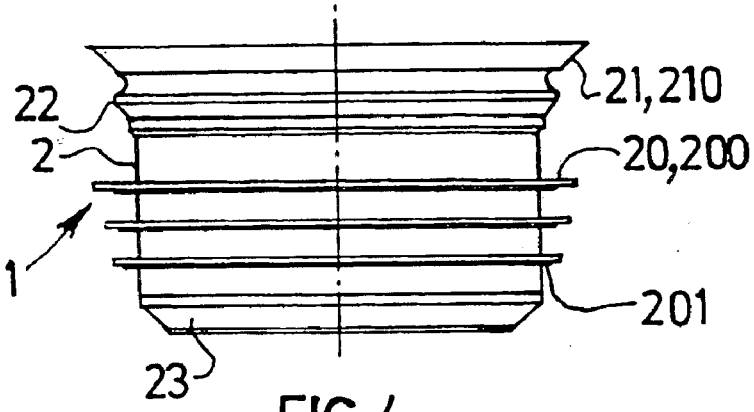
FIG. 4

POURER AND INCORPORATED POURER CAP

FIELD OF THE INVENTION

The invention concerns drip-proof bottle cap pouring devices commonly used in the field of portioned dosing for consumption from bottles such as those generally used for pouring determined doses of aperitifs, syrups, oil, condiments, etc . . .

STATE OF THE ART

Drip-proof pouring devices and the corresponding caps as illustrated in FIGS. 6 and 7 are already well known. These are generally composed of two elements:

A pouring element, where the lower part is hermetically inserted inside the standard sized neck of some vessel, normally a bottle or flask, while the upper part, in the form of a moderately flared circular rim, protrudes externally over the lip of the bottle to provide the drip-proof property.

A plug stopper that acts as a hermetic seal is fixed with a click action in the bottom of the cap in the projection lock system of the seal.

Naturally it is necessary that the effort required for extracting the pouring element from the bottle neck, or the effort required for "de-necking" must be stronger than the effort required to separate the pouring device and cap when the bottle is opened.

Other pouring devices are described in patent applications or patents as follows: WO98/52838, FR 1.156.919, NL 770 38 29, U.S. Pat. No. 2,848,145 and U.S. Pat. No. 2,751,131.

PROBLEMS POSED

On one hand, state of the art drip-proof pouring devices are used only on so-called "low" glass bottle rings, because they are lower than the so-called "high" rings with a difference in height that is generally between 6 to 7 mm.

It is important that a "low" ring is used to compensate the extra thickness of these pouring devices over the lip of the bottle, in order to obtain a closed bottle with a total height that does not exceed the height of "high" ring bottles that are not equipped with pouring devices.

On the other hand these are not easily adapted to all ring diameters, especially to large sized rings such as those on magnum bottles that measure approximately 36 mm.

In particular, they are not well adapted to the irregularities present on the inside of the neck or the ring, and even more so if the inside diameter of the neck is large in size.

Moreover, certain pouring devices may be suitable if the bottle is poured in a single action, but will deteriorate under intensive action for products such as aperitifs or oil, requiring more than fifty open and shut cycles, especially for the joint between the protruding portion of the pouring device, and the skirt inserted in the neck of the vessel or bottle. Certain pouring devices also have a protruding portion with a rather reduced diameter that only covers a narrow part of the neck lip, meaning that any drips fall on the bottle lip or on the bottle itself.

Lastly, certain state of the art pouring devices have high manufacturing costs, high material costs, or sometimes also high insertion costs because of the fact that they cannot be integrated in the bottle cap.

Therefore the invention is aimed at pouring devices suited to all types of glass bottle rings, and more particularly, at caps with an integrated pouring device in order to resolve all of the problems posed.

DESCRIPTION OF THE INVENTION

One of the principal objectives of the invention is composed of a drip-proof pouring device, designed to be inserted inside the bottle neck, generally on screw-top bottles or vessels containing a liquid, composed of a skirt that forms an internal channel, and on its outside surface, with a hermetic fixing system on the neck, that includes at least one flexible peripheral ring to form a hermetic fixing rib; at the end of the so-called "high" end of the skirt in question, is an upper flared portion which totally or partially exits so that it protrudes above the lip of the neck for an established distance H, after the pouring device has been fixed inside the neck, and characterized in that:

a) the nature and/or the thickness of the material that constitutes at least the protruding portion, will be chosen so that the protruding portion is flexible enough to be applied against the lip generally with axial pressure and combined with the closure of the bottle neck by the sealing cap, returning to its initial straightened position, as soon as the pressure is no longer applied, when the bottle is opened.

b) the point of union between the top end of the skirt and the flared portion is reduced in thickness to act as a hinge and to permit the multiple flexions performed by the protruding portion.

The invention resolves all the problems in question satisfactorily. In fact, the pouring devices feature the combination of the following means:

on one hand, considering the presence of at least one flexible peripheral ring that acts as a hermetic fixing system on the bottle neck, the pouring device in this invention can be attached to all types of vessel. It is also possible to apply the device even where there are internal diameter irregularities, generally up to 1 mm or even more, without compromising the hermetic capacity. However, the diameter of the hermetic fixing system must naturally remain suited to the average neck diameter under examination since the pouring device of this invention can be fixed to the neck hermetically only within an established range of diameters;

On the other hand, thanks to the system described in a), the pouring device can be adapted to any type of bottle ring, whether high or low, without having to alter the final height of the closed vessel, since only the protruding portion, generally reduced, is above the bottle lip;

lastly, thanks to the system described in b), the protruding part has excellent resistance capacity to multiple flexion without deterioration or flexibility loss. The term "multiple flexion" refers to at least 50, or even 100 or more bottle opening and closing operations.

To summarise, given the capacities of this invention, the pouring device with the protruding flexible part can be manufactured in a low cost plastic material such as PE or PP, resulting in considerable profits in production costs, both for the price of materials as well as for manufacturing costs, since the demoulding of flexible pouring devices is much easier to manage than less flexible or rigid piece demoulding.

Figure 1:
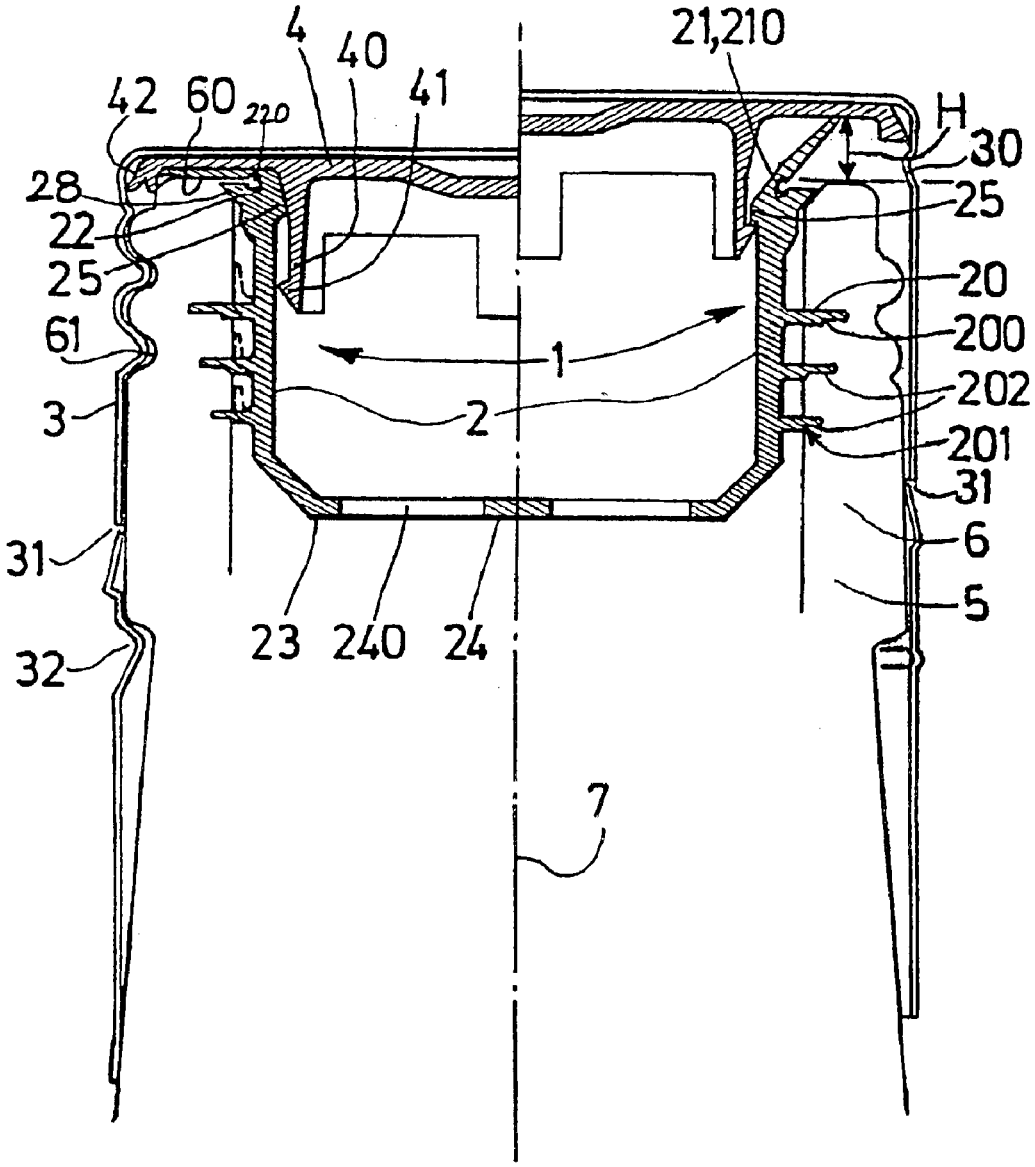
FIG. 1 represents two half cross-sections divided symmetrically in vertical direction (7) vertical section of the neck (6) of a bottle (5) with a threaded bottle ring, closed with a sealing cap (3) including a plastic insert (4) and a pouring device (1) as described in this invention.

The left hand side represents the closed position; the upper flared portion (21) of the pouring device is bent and retained against the lip (60) of the neck.

The right hand side of the drawing shows the position where the bottle is about to be closed using the cap described in this invention, equipped with an insert (4) and a pouring device (1) with a flared portion (21) opened out, and with the height H above the lip (60). This same distribution can be seen when the bottle is in open position.

Figure 2:
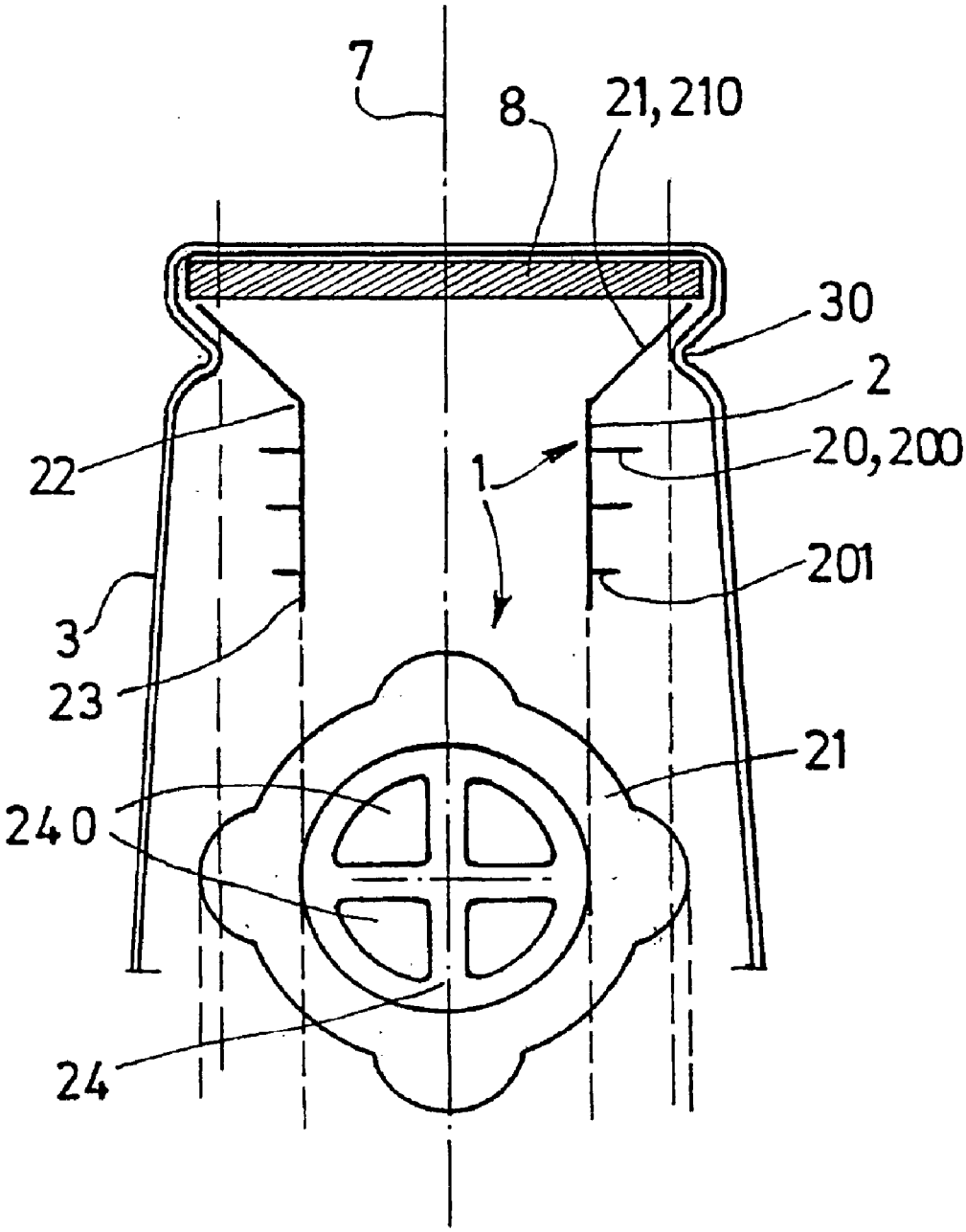

FIG. 2 is a cross section in vertical direction (7) of a closed bottle, similar to the left hand part of FIG. 1, but where the hermetic system is provided by an added seal (8).

FIGS. 3*a* and 3*c* concern the plastic insert (4) used in FIG. 1.

FIG. 3*a* is the vertical symmetrical cross section (7).

FIG. 3*b* shows an enlarged partial cross section of the peripheral edge (41) of the circular lip (40) that provides the temporary adherence with the pouring device (1).

FIG. 3*c* is a view from the bottom of the plastic insert (4).

Figure 5A:
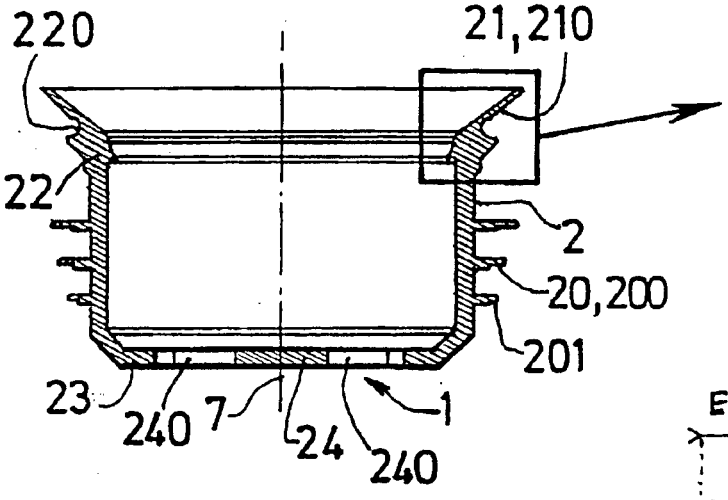
Figure 5D:
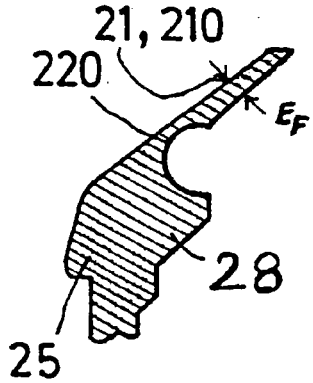
Figure 5B:
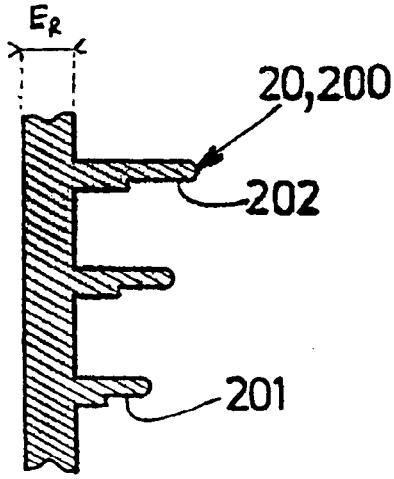
Figure 5C:
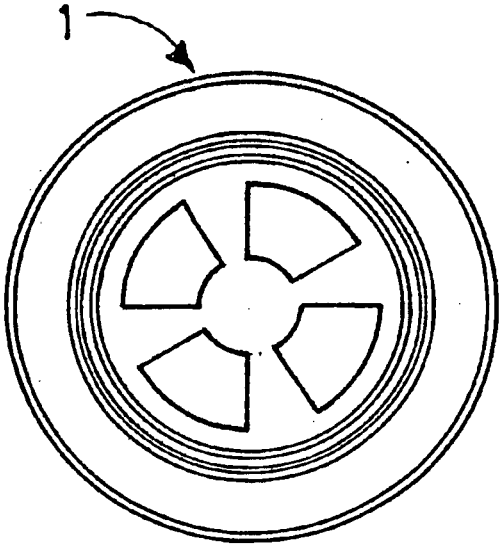

FIGS. 4 to 5*c* refer to the pouring device (1).

FIG. 4 is the side view.

FIG. 5*b* is a partial enlargement of the hermetic fixing system showing the fact that the diameter is reduced gradually the further it moves from the bottom (23) of the skirt (2), and that the thickness of the external edge of the ribbing (200) is reduced.

FIG. 5*c* is a bird's eye view of the pouring device (1).

FIG. 5*d* is an enlargement of the framed detail in FIG. 5*a*.

Figure 6:
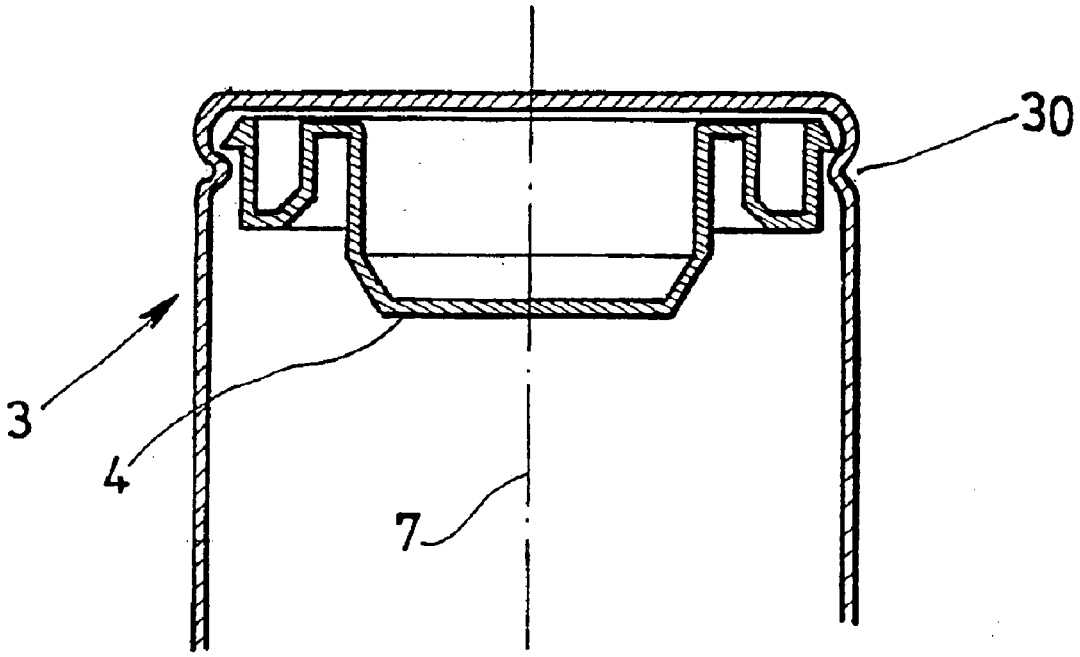
Figure 7:
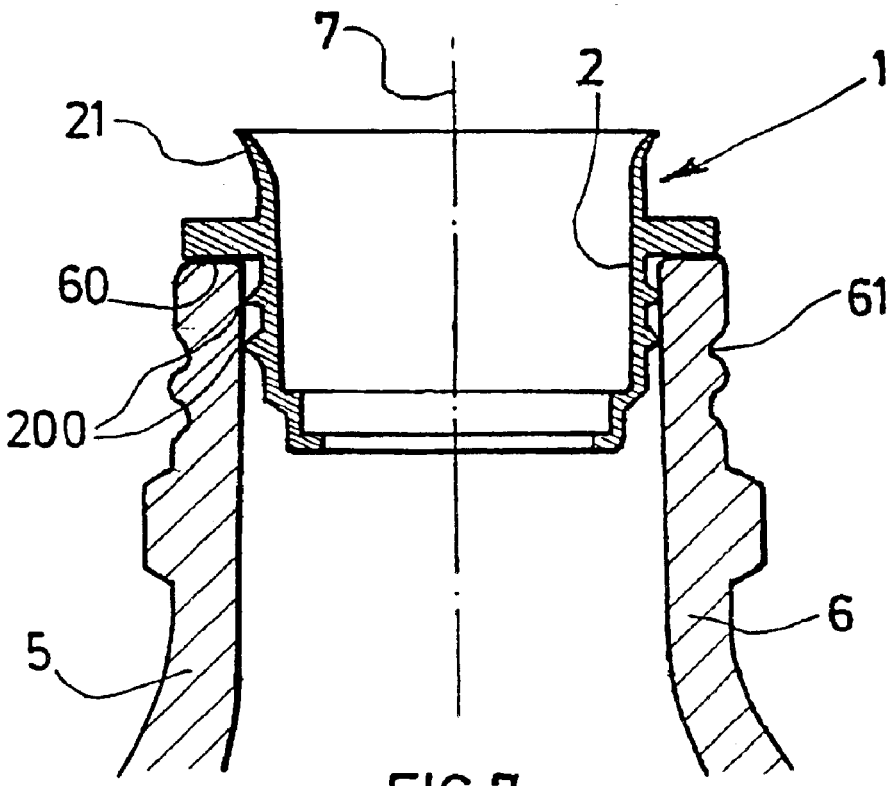

FIGS. 6 and 7 are cross sections showing the state of the art: FIG. 6 shows the cap adapted for the closure of vessels mounted with the pouring device shown in FIG. 7.

Figure 8:
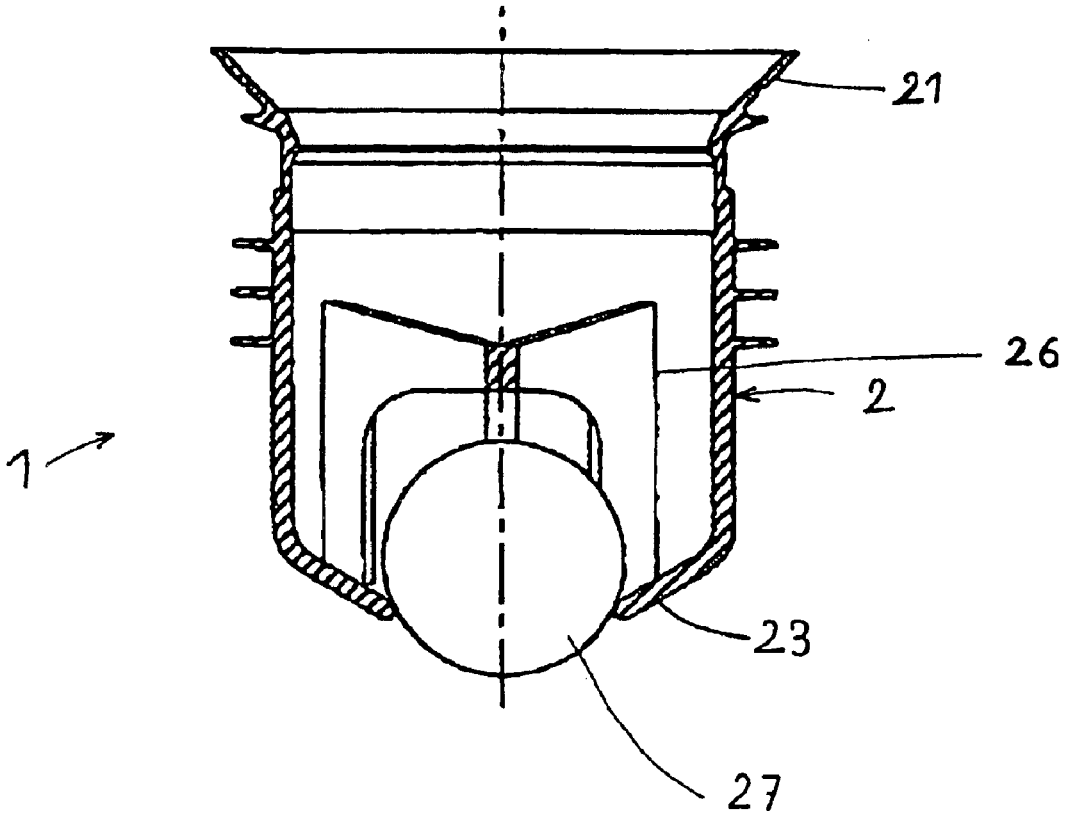

FIG. 8 is similar to FIG. 5*a*, showing the pouring device (1) where the skirt (2) includes a bottom half (23) that can be equipped with an internal divider (24) and an internal rim (26) that can retain a marble (27) that prevents any further filling of the bottle.

DETAILED DESCRIPTION OF THE INVENTION

In this invention, according to the pouring device concept, the top end (22) of the skirt (2) can present an external rim on the outside surface (28) that forms a blocking rim or shoulder that ensures the axial position of the pouring device inside the neck; the external rim in question (28) is forced against the internal edge of the lip (60) so that it blocks the device (1) insertion at a pre-established axial level in the neck (6) permitting the flexible protruding portion in question (210) to adhere to the bottle lip (60).

Materials for this device can be chosen among thermoplastic polymers or co-polymers suitable for moulding application, such as PE, PP, PET, polybutene, or silicon resins that may be in the form of homopolymers or copolymers, and metallocene.

In addition, said material can contain an elastomer, such as polybutadiene, to form a blend composed of a relatively rigid material with an elastomer to produce a pouring device with the required flexibility and permanent spring-back capacity.

According to the invention, the hermetic fixing system can be composed of at least two rows of peripheral ribbing (200) running parallel horizontally. In the enclosed drawings, the pouring device (1) is generally illustrated with three rows of peripheral ribbing (200). The peripheral ribbing (200) as shown in FIGS. 4*a*, 5*a*, and 5*b*, can increase in diameter, the further the ribbing is positioned away from the lower end (23) of the skirt (2).

It is preferable that the lowest ribbing (the so-called "low" ribbing (210)) in other words the ribbing closest to the low end (23) of said skirt, be positioned at a distance less than 10 mm from the low end in question so that the retained liquid is generally less than 1 $cm^3$ when the neck is turned upside down and the vessel is empty.

Moreover, there exists an advantage in producing the ribbing with the central or internal diameter more rigid, and the external peripheral edge more flexible. To obtain this, at least one of the peripheral ribbings (200) must have a reduced thickness on the circular perimeter (202). In this manner, the pouring devices in this invention can be manufactured with a large tolerance level as far as the bottle rings are concerned without compromising the hermetic capacity between the neck and the pouring device.

In this invention, the pouring device in question (1) can be fitted with a flow control system that partially blocks the internal channel and that is composed of a flat bottom or division (24) perforated (240) as shown in FIGS. 1, 2, and 5*c*.

In another version of the invention, as shown in FIG. 8, the skirt (2) can include a low end (23) that can eventually be fitted with an internal divider (24) and an internal rim (26) that retain a marble (27) that forms a check valve to prevent unauthorised refilling of the bottle or vessel (5) once its contents have been consumed.

The pouring device in question (1) can be produced in a solid block moulded piece composed of a single or various plastic materials. It can be composed of a single plastic material, and in this case, to provide a fairly rigid skirt and protruding part (210) that is sufficiently flexible, the average thickness $E_F$ of the flexible protruding part (210) can be less than the thickness $E_r$ of the skirt (2), or even less than: 0.5 $E_F$ as shown in FIGS. 5*b* and 5*d*.

The device can be composed of a moulded solid block made up of a skirt (2) and an upper flared portion (21) in two different plastic materials, the more rigid material for the skirt (2) with the circular ribbing (200), and the more flexible material for the upper flared portion (21).

Another element of the invention consists of a sealing cap (3) composed of:

a) a hermetic closure cap;

b) a pouring device (1) as described in the invention, that is to say as described in any one of the admissible claims 1 to 14;

c) a system for the temporary adhesion of the pouring device (1) to the cap in question (3) so that the pouring device (1) that initially adhered to said cap (3) then adheres to the neck (6) of the vessel (5) in an irreversible manner and when the vessel is closed by the cap.

One of two hermetic closure systems, can be selected: the added seal (8) or the insert (4) fixed inside the cap in question using a blocking projection method (30) or a layer of adhesive, or by force fit insertion.

Illustration 2 shows the added seal method, and the other figures show the plastic insert system.

In the case of the latter, the hermetic closure system can be composed of a plastic insert (4) equipped with a circular rim (40) that ensures all or part of the hermetic sealing capacity. The circular rim (40) can amalgamate with the exterior of the neck (50) lip (60) to form the hermetic closure as illustrated in FIG. 1.

More precisely, the temporary adherence can be formed by the interaction of the peripheral edges (25, 41) applied to the inside of the skirt (2) and the outside of the circular rim (40), using a click-fit or snap-on method as illustrated in FIG. 1.

In this invention, the cap can include a system to guarantee that the contents are intact, and/or initial easy opening with the inclusion of a perforated or easily broken line (31) located above the screw thread area (32).

EXAMPLES OF EMBODIMENTS

FIGS. 1, 3*a*, to 3*c*, 4, 5, to 5*c*, and 8 illustrate the examples of embodiments.

The pouring devices were produced in different materials, more particularly in polybutene, PE, PP or PP co-polymers, and blends of PP or PE with polybutadiene with sufficient content to guarantee the required flexibility.

The pouring devices were manufactured using mould injection, and demoulding resulted very easy due to the flexibility of the curved and angled elements of the devices, object of this invention.

The devices of this invention not only permit adherence to the inside diameter of the bottle necks in spite of surface irregularity, but also guarantee a considerable number of opening and closing actions.

Moreover, they are cheap to produce and easy to insert whether combined with the sealing cap or not.

| REFERENCE LIST | |
|---|---|
| POURING DEVICE | 1 |
| SKIRT | 2 |
| HERMETIC FIXING SYSTEM | 20 |
| RIBBING | 200 |
| LOW RIBBING | 201 |
| PERIPHERAL RING | 202 |
| UPPER FLARED PORTION | 21 |
| PROTRUDING PORTION | 210 |
| HIGH END/POINT OF UNION | 22 |
| REDUCED PORTION | 220 |
| LOW END | 23 |
| INTERNAL DIVIDER | 24 |
| ORIFICES/PERFORATIONS | 240 |
| PERIPHERAL EDGE | 25 |
| INTERNAL RIM | 26 |
| MARBLE | 27 |
| EXTERNAL RIM | 28 |
| SEALING CAP | 3 |
| BLOCKING PROJECTION | 30 |
| EASY RUPTURE LINE | 31 |
| INSERTION AREA | 32 |
| PLASTIC INSERT | 4 |
| CIRCULAR EDGE | 40 |
| PERIPHERAL RIM | 41 |
| PERIPHERAL LIP | 42 |
| VESSEL | 5 |
| NECK | 6 |
| LIP | 60 |
| THREAD | 61 |
| AXIS | 7 |
| ADDED SEAL | 8 |

What is claimed is:

1. A drip-proof pouring device (1) for use inside of a neck of a bottle, comprising:

a skirt (2) forming an internal channel and having an external surface, a hermetic sealing system disposed on the external surface, the hermetic sealing system comprising at least one flexible peripheral ring forming a ribbing, an upper flared portion (21) disposed at a top end (22) of the skirt and having a protruding portion (210) exiting above a lip (60) of the neck at a height (H) when the pouring device is disposed inside the neck of the bottle, wherein the protruding portion (210) is flexible and includes a thickness so it can flex and regain its original uncompressed position when the pressure is released, wherein a point of union between the top end (22) of the skirt and the flared portion is reduced in thickness to function as a hinge and to permit the multiple flexion action by the protruding portion, wherein an external surface of the top end (22) of the skirt (2) has an external rim on its outside surface (28) to form a block system or shoulder to fix the pouring device position in the neck, the external rim in question (28) is pressed against the internal rim of the lip (60) so that it blocks the pouring device (1) at an established level inside the neck (6), and permits the application of the flexible protruding portion (210) against the lip, and wherein the pouring device is composed of mold solid block piece.

2. Pouring device as claimed in claim 1, wherein the material is chosen from among thermoplastic polymers or copolymers suitable for moulding, such as PE, PP, PET, polybutene or metallocene.

3. Pouring device as claimed in claim 1, wherein the material in question contains an elastomer such as polybutadiene.

4. Pouring device as claimed in claim 1, wherein the hermetic fixing system is composed of at least two peripheral rows of ribbing (200) arranged parallel horizontally.

5. Pouring device as described in claim 4 in which the external diameter of each peripheral ribbing (200) increases the further it is placed from the low end (23) of the skirt (12).

6. Pouring device as described in claim 5 in which the hermetic fixing system (20) includes a rib, described as "low" (201) closest to the low end of the skirt (23) and positioned less than 10 mm from the low end so that the retained liquid does not exceed 1 $cm^3$ when the vessel is empty and the neck is turned upside-down.

7. Pouring device as claimed in claim 5, in which the external perimeter of at least one peripheral ribbing (200) is reduced in thickness (202).

8. Pouring device as claimed in claim 1, in which the skirt includes a system for limiting the flow, composed of a partial sealing of the internal channel, in the form of a flat divider (24) perforated with openings (240).

9. Pouring device as claimed in claim 1, in which the skirt (2) includes a low end (23) equipped with an internal divider (24) and internal rim (26) that retains a marble (27) to form a check valve to prevent unauthorised filling of the bottle or vessel (5) once its initial contents have been consumed.

10. Pouring device as claimed in claim 1, composed of a moulded solid block made up of a single or several plastic materials.

11. Pouring device as described in claim 10 composed of a single plastic material where the average thickness $E_F$ of the flexible protruding portion in question (210) is less than the thickness E, of the skirt (2).

12. Pouring device as described in claim 11 in which the average thickness $E_F$ is less than 0.5 E.

13. Pouring device as described in claim 10 in which the moulded solid block part that includes the skirt (2) and the upper flared portion (21) is composed of two different plastic materials; the more rigid plastic material forming the skirt (2) equipped with ribbing (200) the more flexible plastic material forming the upper flared portion (21).

14. Sealing cap (3) composed of:

a) a hermetic sealing system;

b) a pouring device (1) as described in claim 1; and c) a temporary adherence system between the pouring device in question (I) the sealing cap in question (3) conceived so that the pouring device (1) that adheres initially to the cap (3) then adheres to the neck (6) of the vessel in question (5) irreversibly during the application of the cap on the vessel.

15. Sealing cap as described in claim 14 in which the hermetic sealing system is chosen between an added seal (8) or an insert (4) attached to the inside of the cap, either by a blocking projection (30) or by a layer of adhesive, or by force fit.

16. Sealing cap as described in claim 14 in which the hermetic sealing system is composed of a plastic insert (4) normally equipped with a circular rim (40).

17. Sealing cap as described in claim 16 in which the circular rim in question (40) adheres to the pouring device (1) normally with the inside of the skirt in question (2) to form the temporary adherence system.

18. Sealing cap as claimed in claim 16, in which the circular rim (40) adheres to the outside of the lip (60) of the neck (6) to form the hermetic sealing system in question.

19. Sealing cap as claimed in claim 16, in which the temporary adherence system is formed by the interaction of the peripheral perimeters (25, 41) by snap-on or click-fit action on the inside of the skirt (2) and the outside of the circular rim in question (40) respectively.

20. Sealing cap as claimed in claim 14, including the systems to guarantee that the contents remain intact, and/or the initial easy opening with the inclusion of a perforated or easily broken line.

* * * * *